US006682398B2

(12) United States Patent
Meyer

(10) Patent No.: US 6,682,398 B2
(45) Date of Patent: Jan. 27, 2004

(54) METHOD FOR CHARACTERIZING THE PLANARIZING PROPERTIES OF AN EXPENDABLE MATERIAL COMBINATION IN A CHEMICAL-MECHANICAL POLISHING PROCESS; SIMULATION TECHNIQUE; AND POLISHING TECHNIQUE

(75) Inventor: Frank Meyer, Dresden (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/208,465

(22) Filed: Jul. 29, 2002

(65) Prior Publication Data

US 2003/0022596 A1 Jan. 30, 2003

(30) Foreign Application Priority Data

Jul. 27, 2001 (DE) ..... 101 36 742

(51) Int. Cl.[7] ..... B24B 1/00

(52) U.S. Cl. ..... 451/5; 451/41; 451/57; 438/692; 716/7

(58) Field of Search ..... 451/5, 41, 6, 285–289, 451/28, 63, 57; 356/630, 445, 625, 38, 326, 328; 716/7, 4.19; 438/692, 693; 156/345

(56) References Cited

U.S. PATENT DOCUMENTS

| | | | | | |
|---|---|---|---|---|---|
| 5,913,712 | A | * | 6/1999 | Molinar | 451/41 |
| 6,045,435 | A | * | 4/2000 | Bajaj et al. | 451/41 |
| 6,120,348 | A | * | 9/2000 | Fujita et al. | 451/5 |
| 6,120,354 | A | * | 9/2000 | Koos et al. | 451/41 |
| 6,132,294 | A | * | 10/2000 | Lin | 451/41 |
| 6,135,863 | A | * | 10/2000 | Zhang et al. | 451/56 |
| 6,227,949 | B1 | * | 5/2001 | Yi et al. | 451/57 |
| 6,234,877 | B1 | * | 5/2001 | Koos et al. | 451/41 |
| 6,248,002 | B1 | * | 6/2001 | Wang et al. | 451/41 |
| 6,302,766 | B1 | * | 10/2001 | Sethuraman et al. | 451/41 |
| 6,338,668 | B1 | * | 1/2002 | Lin et al. | 451/9 |
| 6,379,225 | B1 | * | 4/2002 | Robinson et al. | 451/41 |
| 6,572,439 | B1 | * | 6/2003 | Drill et al. | 451/5 |

FOREIGN PATENT DOCUMENTS

WO WO 02/052634 A2 7/2002

OTHER PUBLICATIONS

F. Meyer et al.: "Determination of the Waver Level Planarisation Behaviour for an Oxide CMP Process Using the MIT Test Pattern", *CMP/MIC Conference* , Santa Clara, CA, Mar. 2001.

Dennis Ouma et al. : "An Integrated Charcterization and Modeling Methodology for CMP Dielectric Planarization", *International Interconnect Technology Conference* ,San Francisco, CA, Jun. 1998.

B. Stine et al.: A Closed–Form Analytic Model for ILD Thickness Variation In CMP Processes, *Proc. CMP–MIC* , Santa Clara, CA, Feb. 1997, pp. 1–7.

F.W. Preston: "The Theory and Design of Plate Glass Polishing Machines",*Journal of the Society of Glass Technology* ,1927, pp. 214–256.

F.W. Preston: "The Traction of Glass Polishing", *Journal of the Society of Glass Technology* ,vol.12, No. 45, 1928, pp. 3–7.

* cited by examiner

*Primary Examiner*—George Nguyen
(74) *Attorney, Agent, or Firm*—Laurence A. Greenberg; Werner H. Stemer; Ralph E. Locher

(57) ABSTRACT

A method for characterizing planarizing properties of a selected expendable material combination in a chemical-mechanical polishing process includes steps of: providing a combination of expendable materials including a softcloth and a polishing agent; providing test substrates with test patterns with different feature densities; performing a polishing process for each of the test substrates while the respective combination of the values for the processing parameters (pressure and velocity) is maintained until saturation is achieved; determining a characteristic quantity for the global grade level from the test substrates that have been polished; and determining expendable material parameters that characterize the planarizing properties for the selected expendable material combination from a functional relationship between the characteristic quantity for the global grade level to a quotient of the relative velocity and the pressure for each one of the test substrates.

11 Claims, 3 Drawing Sheets

METHOD FOR CHARACTERIZING THE PLANARIZING PROPERTIES OF AN EXPENDABLE MATERIAL COMBINATION IN A CHEMICAL-MECHANICAL POLISHING PROCESS; SIMULATION TECHNIQUE; AND POLISHING TECHNIQUE

BACKGROUND OF THE INVENTION

1. Field of the Invention

The present invention relates to a method for characterizing the planarizing properties of a combination of expendable materials in a chemical-mechanical polishing (CMP) process, according to which a substrate that is to be polished, specifically a semiconductor wafer, is pressed onto a softcloth and rotated relative to the cloth for a defined polishing time.

The invention also relates to a method for characterizing and simulating a chemical-mechanical polishing process and a method for the chemical-mechanical polishing of a substrate, namely a semiconductor wafer.

Chemical-mechanical polishing is a method of planarizing or polishing substrates, which is common particularly in semiconductor fabrication. The advantage of planarized surfaces is that a subsequent exposure step can be carried out with a higher resolution, because the required depth of focus is smaller because of the reduced surface topography.

The basic problem in this respect is that different densities and spacings of features in the layout of a semiconductor chip influence the planarizing properties of the CMP process. Unfavorably selected processing parameters then lead to a large variation in layer thickness across the chip surface subsequent to the CMP process (global topography). On the other hand, an unfavorably selected circuit layout leads to insufficient planarizing. The insufficient planarizing impairs the follow-up processes and thus the product characteristics, because of the associated variations in layer thickness across the chip surface—that is to say, across the image field surface of a subsequent exposure step. In particular, the processing window of a subsequent lithography step shrinks because of the reduced depth of focus.

Another problem in CMP is that the polishing result is influenced by a number of interacting processing parameters. Hitherto, the adjustable processing parameters, such as the rotational velocities of the polishing disk and substrate holder, the pressure, the polishing time, the quality of the softcloth, the selection of the polishing agent, or the polishing agent flow, have usually been individually adjusted for each new layer that is polished on the semiconductor wafer and for almost every new product. The optimal parameters are typically determined by trial and error in a series of test sequences. These experiments require an appreciable expenditure of time and money, as well as the presence of a sufficient number of wafers of a new product layout. The polishing agent has a mechanical and chemical erosion property (slurry).

SUMMARY OF THE INVENTION

It is accordingly an object of the invention to provide a method for characterizing the planarizing properties of a selected expendable material combination in a chemical-mechanical polishing process which overcomes the above-mentioned disadvantages of the prior art methods of this general type.

It is another object of the invention to provide a method with which the polishing result of a CMP process can be characterized more simply, and particularly to provide a method in which the number of independent parameters that must be taken into account can be reduced.

With the foregoing and other objects in view there is provided, in accordance with the invention, a method for characterizing the planarizing properties of a combination of expendable materials in a chemical-mechanical polishing (CMP) process, whereby a substrate that will be polished, particularly a semiconductor wafer, is pressed onto a softcloth and is rotated relative to the wafer for a specified polishing time. The method includes the following steps: a) providing a combination of expendable materials including a softcloth and a polishing agent; b) prescribing a respective value range for the processing parameters of pressure (p) and relative rotational velocity (v) of the substrate and the softcloth; c) providing test substrates with test patterns with different feature densities; d) for each of the provided test substrates, prescribing a combination of values for the processing parameters of pressure and relative rotational velocity of the substrate and softcloth; e) performing a polishing process for each of the test substrates while the respective combination of values for the processing parameters is maintained until saturation is achieved; f) determining a characteristic quantity for the global grade level from the polished test substrates; and g) determining expendable material parameters that characterize the planarizing properties for the selected expendable material combination from the functional relationship between the characteristic quantity for the global grade level and the quotient of the relative velocity and pressure for each of the test substrates.

The inventive method has the advantage that an experimental characterizing only has to be performed once for a given expendable material combination, and namely is performed on a test substrate including test patterns with various feature densities. The results of characterizing the test substrate serve for determining expendable material parameters that can exhaustively describe the planarizing properties of this expendable material combination.

This makes it possible to compare the planarizing properties of different expendable material combinations with one another or to simulate polishing results with other polishing parameters and new layouts.

The test substrates provided in step (c) expediently contain line patterns with a period between 100 and 500 $\mu$m, particularly of 250 $\mu$m, and increasing feature densities, preferably in the range from 4% up to 72%.

In a preferred development of the method, the filter length FL is determined in step (e) as the characteristic quantity for the global grade level. The filter length, which is defined by Stine (B. Stine et al, "A Closed-Form Analytic Model For ILD Thickness Variation in CMP Processes", CMP-MIS Conference, Santa Clara, Calif., February 1997), describes a window with a characteristic quantity FL over which an average is formed in a manner suitable for obtaining effective feature densities from concrete feature densities.

For instance, an averaging of the concrete feature densities can occur in the model calculation with a two-dimensional Gaussian distribution of a half-width FL. But other weight functions are also appropriate filters, for instance quadratic, cylindrical and elliptical weight functions. The elliptical and Gaussian weight functions exhibit the smallest error according to the present state of knowledge and are therefore preferable.

In a preferred development of the method, in step (f) two characteristic expendable material parameters are determined from a linear relationship between the filter length FL and the quotient of the relative velocity v and pressure p.

The slope MI and the axis segment FixFL of the fit line are expediently determined as characteristic expendable material parameters from the following linear relation:

$$FL(v/p)=MI*(v/p)+FixFL.$$

The fit line can be determined by linear regression. The two quantities MI (mechanical influence) and FixFL (a constant offset of the filter length) are then sufficient for characterizing the selected softcloth/polishing agent combination in an unambiguous fashion.

An inventive method for characterizing and simulating a chemical-mechanical polishing (CMP) process, whereby a substrate that will be polished, namely a semiconductor wafer, is pressed onto a softcloth and rotated relative to it for a defined polishing time, includes the following steps: determining layout parameters of the substrate that will be polished; prescribing a requirement profile for the CMP process result for the substrate that will be polished; specifying an expendable material combination including a softcloth and a polishing agent; characterizing the planarizing properties of the specified expendable material combination according to the method that was described above; prescribing a set of respective values for the processing parameters of the pressure (p) and the relative rotational velocity (v) of the substrate and softcloth; simulating the CMP process result for the substrate that will be polished by using the specified values for the processing parameters in connection with the previously specified characterizing expendable material parameters for determining the required polishing time; and evaluating whether the CMP process result satisfies the prescribed requirement profile.

Utilizing the above-described characterizing expendable material parameters makes a particularly effective simulation of the CMP process result possible.

The invention further provides a method for the chemical-mechanical polishing of a substrate, particularly a semiconductor wafer, whereby a CMP process is simulated with the method. A layer that will be planarized is deposited on a substrate, and the substrate is polished for a polishing time derived from the simulation. This has the additional advantage that it is unnecessary to perform a new experimental test sequence for each new substrate layout. Rather, the results of an experimental characterization of the test substrate can be utilized for the meaningful simulation and subsequent polishing of a number of various product layouts.

Other features which are considered as characteristic for the invention are set forth in the appended claims.

Although the invention is illustrated and described herein as embodied in method for characterizing the planarizing properties of an expendable material combination in a chemical-mechanical polishing process; simulation technique; and polishing technique, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In an exemplary embodiment, a batch of 25 test wafers that have been structured using a test mask is provided for characterizing a particular softcloth/polishing agent combination.

The test mask consists of regions with high areas (Up) and low areas (Down) with specific grade levels, for instance isolated blocks or line patterns. The ratio of up areas to down areas determines the feature density, the limits of which are defined by a density of 0% (only down areas) and a density of 100% (only up areas).

Figure 2:
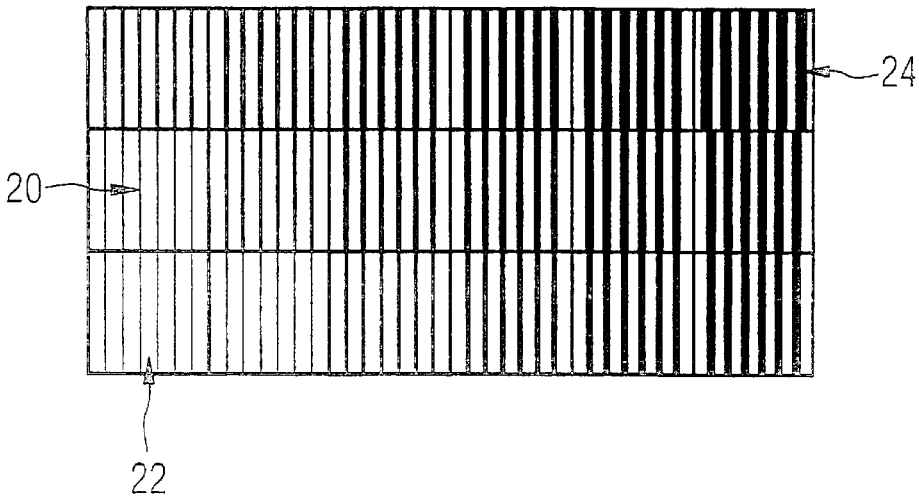
FIG. 2 is a schematic of the test patterns of a test substrate.

As represented in FIG. 2, the relevant part 20 of the test mask contains line patterns with a period (the width of the up and down areas together) of 250 $\mu$m. The line patterns are arranged in 18 blocks with a size of 2×2 $mm^2$, with rising feature densities of from 4% (block 22) to 72% (block 24). The increase in density from one block to the next equals 4 percentage points.

The period equals 250 $\mu$m in all blocks, regardless of the feature density. For instance, the line pattern block 22 contains up areas with a width of 10 $\mu$m and down areas with a width of 240 $\mu$m, which corresponds to a density of 10/250=4%. The line pattern block 24 contains up areas with a width of 180 $\mu$m and down areas with a width of 70 $\mu$m, which corresponds to a density of 180/250=72%.

Figure 1:
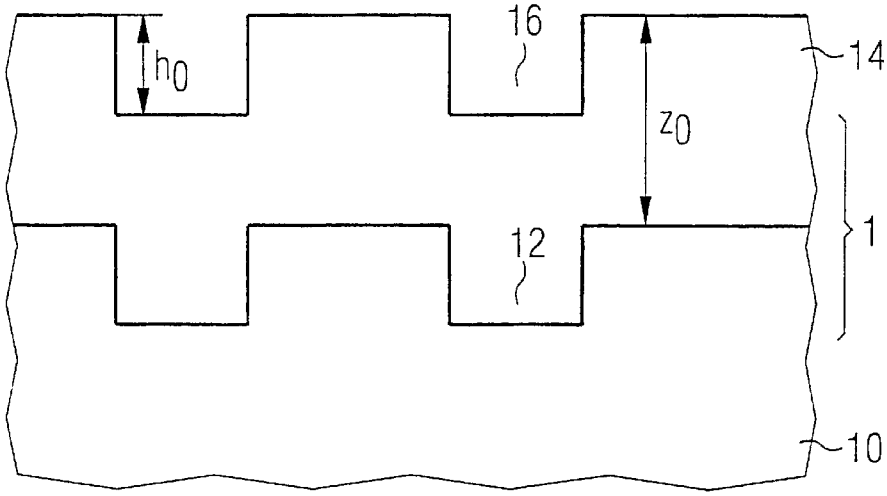
FIG. 1 is a schematic of a layer structure that will be polished in a CMP process.

Test substrates 1 are produced with this test mask, as schematically represented in FIG. 1. Trenches 12 are etched into the silicon wafer 10 to a depth of 400 nm, and then an oxide layer 14 is deposited with a thickness of $z_o$=1250 nm. Test profiles emerge with an oxide grade 16 with a height of $h_o$=400 nm.

Five such test wafers are polished for progressively longer polishing times for a set of varying mechanical polishing parameters. The mechanical polishing parameters are derived from a statistical experiment which maps a velocity-pressure parameter space and thereby prescribes different value combinations for pressure, table velocity and carrier velocity for each experiment, for instance as shown in table 1. A value range is defined for the parameters of pressure, table velocity and carrier velocity, respectively. For each value range, concrete values are prescribed in order to form the value combinations within the parameter space. The relative rotational velocity of the substrate and the softcloth can be calculated from the table velocity and the carrier velocity.

TABLE 1

| Experiment Nr. | Pressure (psi) | Table velocity (rpm) | Carrier velocity (rpm) |
|---|---|---|---|
| 1 | 3 | 35 | 110 |
| 2 | 6 | 35 | 110 |
| 3 | 4, 5 | 58 | 95 |

TABLE 1-continued

| Experiment Nr. | Pressure (psi) | Table velocity (rpm) | Carrier velocity (rpm) |
|---|---|---|---|
| 4 | 3 | 80 | 80 |
| 5 | 6 | 80 | 80 |

After a sufficiently long polishing time, the local grades of the various density patterns are eroded. The global grade level (i.e. the height difference between the highest and lowest points on the wafer topography) becomes saturated. The global grade level can then no longer be reduced by further polishing.

Because the polishing rate of a polishing process varies in known fashion with the product of the relative velocity and pressure, the polishing rate RR is determined for each processing parameter combination, and the polishing time is adapted for the five test wafers, accordingly, so that the saturation range for each parameter combination will be detectable. Thus, the wafer is polished for a shorter time, for instance between 60 s and 120 s, at a higher polishing rate, and for a longer time, for instance between 250 s and 400 s, at a lower polishing rate.

The global grade level after polishing is derived from the density variation in the test substrate and later in the real layout. The polishing behavior is schematically represented in FIG. 3.

Figure 3A:
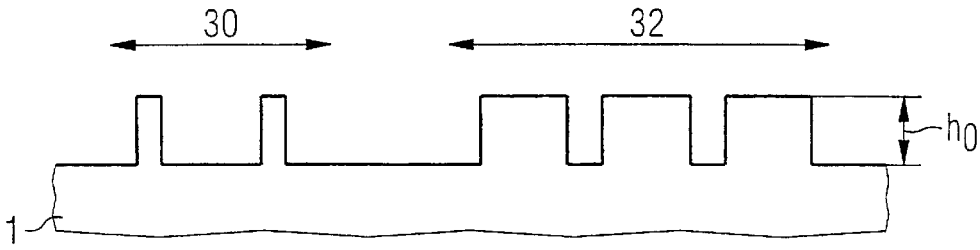
FIGS. 3A–3C schematically show the time behavior of a CMP polishing process.
Figure 3B:
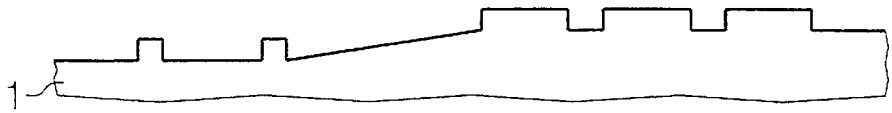
Figure 3C:
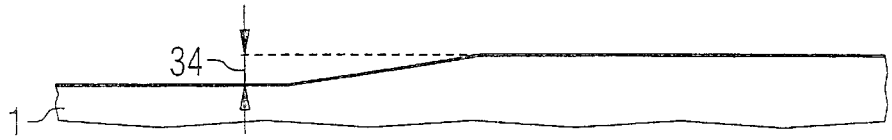

The test substrate 1 contains regions 30 with a low feature density and regions 32 with a high feature density (FIG. 3(*a*)). The up areas in the blocks 30 with the low density erode more rapidly than in the blocks 32 with the high pattern density (FIG. 3(*b*)). After a sufficiently long polishing time, the local grades are eroded; and a global grade level 34 sets in (FIG. 3(*c*)), which cannot be reduced even with further polishing.

The effective pattern density is defined as the ratio of up areas to the overall surface area in a window with a specified size, which was defined by Stine as the filter length FL (B. Stine, loc. cit.).

This filter length FL is independent of the layout and characterizes the planarizing properties of a process. This model was improved by replacing the window with a circular weighting function (D. Ouma, "An Integrated Characterization and Modeling Methodology for CMP Dielectric Planarizing", International Interconnect Technology Conference, San Francisco, Calif., June 1998), which is convoluted with the layout.

It has now been discovered that, given prescribed processing parameters, the residual global grade level $St_{global}(t)$ after the polishing time t is still dependent for sufficiently long times on the initial grade level $h_o$ and the difference between the minimum and maximum effective densities of the layout, here the test substrate:

$$St_{global}(t\text{->}\infty)=h_o\Delta\rho_{eff}(FL,\text{ layout}),\text{ where}$$

Figure 4:
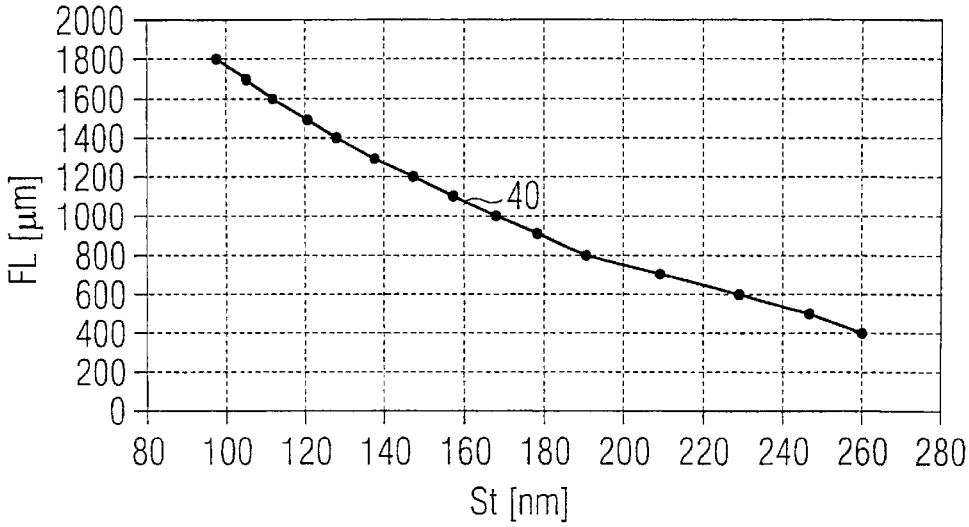
FIG. 4 is a graph of the relationship between the filter length and the saturated global grade level for a test pattern with an initial grade level of 400 nm.

$\Delta\rho_{eff}$ is the maximum difference of the effective densities. This difference is a function of the layout and the filter length FL. With the filter length and the weighting function, the FL can be determined from the saturated global grade level given a layout and a defined initial grade level $h_0$. Reference numeral 40 in FIG. 4 is the relationship between the filter length FL and the global grade level St for an initial grade level $h_0$ of 400 nm and the described test pattern.

The polishing results for an average chip on each wafer are then plotted against the polishing time given the various parameter combinations. The saturated global grade level St is read, and the filter length is derived from this using the functional relation represented in FIG. 4.

Figure 5:
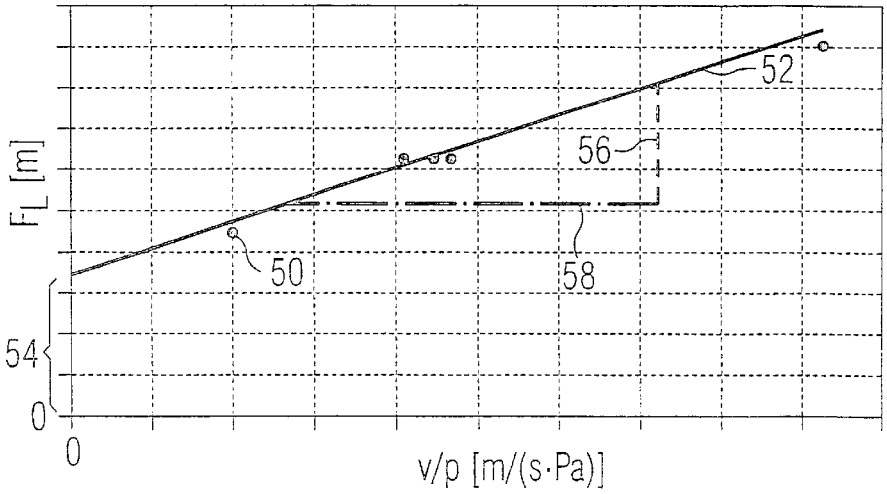
FIG. 5 is a graph of the calculated filter length as a function of a relationship between relative velocity v and pressure p, for five test substrates.

For each parameter set, the calculated filter length is plotted against the ratio of relative velocity and pressure v/p. FIG. 5 represents the individual data points 50 for the five test wafers of a parameter set. As is immediately apparent, the relationship between the filter length FL and the ratio v/p can be described by a linear function 52:

$$FL(v/p)=MI*(v/p)+FixFL.$$

This linear function can be unambiguously characterized by two characteristic quantities: the axis segment FixFL 54 and the slope MI of the line, which is derived from the quotient of the distances 56 and 58. In practice, MI and FixFL can be computed by linear regression.

Thus, the influence of the softcloth and polishing agent on the CMP process can be described by only two parameters, MI and FixFL. With these parameters, the planarizing properties of various expendable material combinations can be easily compared.

Furthermore, polishing results with other polishing parameters and new layouts can also be simulated with the extracted data. The filter length required for this is derived from the utilized expendable material combination of the softcloth and the polishing agent. The polishing rate RR=Δh/Δt is defined by Preston in the following manner:

$$RR=K*F/A*v,$$

with the erosion rate K, the pressure F per unit area A and the relative velocity v.

I claim:

1. A method for characterizing planarizing properties of a selected expendable material combination in a chemical-mechanical polishing process, which comprises:

providing a combination of expendable materials including a softcloth and a polishing agent;

prescribing a respective value range for processing parameters including a pressure and a relative rotational velocity between a substrate and a softcloth;

providing test substrates with test patterns with different feature densities;

for each of the test substrates, prescribing a combination of values for the processing parameters of the pressure and the relative rotational velocity of the substrate and the softcloth;

performing a polishing process for each of the test substrates while the respective combination of the values for the processing parameters is maintained until saturation is achieved;

determining a characteristic quantity for the global grade level from the test substrates that have been polished; and determining expendable material parameters that characterize the planarizing properties for the selected expendable material combination from a functional relationship between the characteristic quantity for the global grade level to a quotient of the relative velocity and the pressure for each one of the test substrates.

2. The method according to claim 1, wherein: the test patterns of the test substrates include line patterns with a period between 100 and 500 μm and the feature densities increase.

3. The method according to claim 2, wherein: the test patterns of the test substrates include line patterns with a period of 250 μm.

4. The method according to claim 2, wherein: the feature densities of the test substrates increase from 4% up to 72%.

5. The method according to claim 2, wherein: the characteristic quantity for the global grade level that is determined is the filter length.

6. The method according to claim 5, wherein:

the step of determining the expendable material parameters includes determining two characteristic expendable material parameters from a linear relationship between the filter length and the quotient of the relative velocity and the pressure.

7. The method according to claim 5, wherein:

the step of determining the expendable material parameters includes determining a slope MI and an axis segment FixFL from a linear relationship FL(v/p)=MI*(v/p)+FixFL, whereby FL represents the filter length, v represents the relative velocity, and p represents the pressure.

8. The method according to claim 1, wherein:

the polishing process is performed by pressing each of the test substrates onto a softcloth and rotating each of the test substrates relative to the softcloth for a specified polishing time.

9. The method according to claim 1, wherein: the test substrates are semiconductor wafers.

10. A method for characterizing and simulating a chemical-mechanical polishing process, which comprises:

determining layout parameters of a substrate that will be polished;

prescribing a requirement profile for the chemical-mechanical polishing process for the substrate that will be polished;

providing an expendable material combination including a softcloth and a polishing agent;

performing a method for characterizing planarizing properties of the expendable material combination in the chemical-mechanical polishing process, which includes steps of:

prescribing a respective value range for processing parameters including a pressure and a relative rotational velocity between the substrate and the softcloth, providing test substrates with test patterns with different feature densities, for each of the test substrates, prescribing a combination of values for the processing parameters of the pressure and the relative rotational velocity of the substrate and the softcloth, performing a polishing process for each of the test substrates while the respective combination of the values for the processing parameters is maintained until saturation is achieved, determining a characteristic quantity for the global grade level from the test substrates that have been polished, and determining expendable material parameters that characterize the planarizing properties for the expendable material combination from a functional relationship between the characteristic quantity for the global grade level to a quotient of the relative velocity and the pressure for each one of the test substrates;

prescribing a set of specified values for the processing parameters of the pressure and the relative velocity of the substrate and the softcloth;

simulating a result of the chemical-mechanical polishing process for the substrate that will be polished by using the specified values for the processing parameters in connection with the expendable material parameters in order to determine a required polishing time; and evaluating whether the result of the chemical-mechanical polishing process satisfies the requirement profile that has been prescribed.

11. A method for chemically-mechanically polishing a substrate, which comprises:

simulating a chemical mechanical process using the method according to claim 10;

depositing a layer that will be planarized on a substrate; and polishing the substrate for a polishing time that is derived from the simulating step.

* * * * *